US010046435B2

(12) United States Patent
Sjolander et al.

(10) Patent No.: US 10,046,435 B2
(45) Date of Patent: Aug. 14, 2018

(54) GRINDING APPARATUS WITH LOAD CONTROL

(71) Applicant: C.M.E. BLASTING & MINING EQUIPMENT LTD., Oakville (CA)

(72) Inventors: Bo Thomas Sjolander, Oakville (CA); Bjorn Sjolander, Oakville (CA)

(73) Assignee: C.M.E. BLASTING & MINING EQUIPMENT LTD., Oakville (CA)

( * ) Notice: Subject to any disclaimer, the term of this patent is extended or adjusted under 35 U.S.C. 154(b) by 70 days.

(21) Appl. No.: 14/910,939

(22) PCT Filed: Aug. 12, 2014

(86) PCT No.: PCT/CA2014/000619

§ 371 (c)(1),
(2) Date: Feb. 8, 2016

(87) PCT Pub. No.: WO2015/021531

PCT Pub. Date: Feb. 19, 2015

(65) Prior Publication Data

US 2016/0184962 A1 Jun. 30, 2016

(30) Foreign Application Priority Data

Aug. 12, 2013 (CA) ..... 2823643

(51) Int. Cl.
*B24B 49/00* (2012.01)
*B24B 49/16* (2006.01)
(Continued)

(52) U.S. Cl.
CPC ..... *B24B 49/16* (2013.01); *B24B 3/33* (2013.01); *B24B 51/00* (2013.01); *B24B 55/02* (2013.01)

(58) Field of Classification Search
CPC ..... B24B 49/16; B24B 3/33; B24B 51/00; B24B 51/02
(Continued)

(56) References Cited

U.S. PATENT DOCUMENTS 5,070,654 A * 12/1991 Manqvist ..... B24B 3/33 409/200
5,193,312 A * 3/1993 Gudmundsson ..... B23Q 1/50 451/159
(Continued)

FOREIGN PATENT DOCUMENTS

EP 0356663 A2 3/1990

OTHER PUBLICATIONS

International Search Report and Written Opinion mailed in corresponding International Patent Application No. PCT/CA2014/000619 dated Nov. 17, 2014, consisting of 8 pp.
(Continued)

*Primary Examiner* — George Nguyen
(74) *Attorney, Agent, or Firm* — Volpe & Koenig, P.C.

(57) ABSTRACT

The present disclosure relates to grinding apparatus for grinding the hard metal inserts of rock drill bits, said grinding apparatus having said grinding machine equipped with a grinding cup driven by a motor to rotate about its longitudinal axis wherein the support system comprises an arm or lever system to control vertical movement of the grinding machine and means to provide grinding pressure, wherein the means to provide grinding pressure may be a linear actuator and load cell assembly pivotally connected to the arm or lever system.

31 Claims, 19 Drawing Sheets

(51) Int. Cl.
*B24B 51/00* (2006.01)
*B24B 3/33* (2006.01)
*B24B 55/02* (2006.01)

(58) Field of Classification Search
USPC ..... 451/4, 5
See application file for complete search history.

(56) References Cited

U.S. PATENT DOCUMENTS

| | | | | |
|---|---|---|---|---|
| 5,639,273 | A * | 6/1997 | Sjolander | B23B 31/1175 451/270 |
| 7,402,093 | B2 | 7/2008 | Sjolander | |
| 2004/0014406 | A1* | 1/2004 | Sjolander | B23Q 11/0021 451/241 |
| 2007/0004320 | A1* | 1/2007 | Lindgren | B24B 3/33 451/11 |

OTHER PUBLICATIONS

International Preliminary Report on Patentability completed in corresponding International Patent Application No. PCT/CA2014/000619 dated Nov. 13, 2015, consisting of 10.

* cited by examiner

GRINDING APPARATUS WITH LOAD CONTROL

This application is a 371 National Phase of International Patent Application No. PCT/CA2014/000619, filed on Aug. 12, 2014, which claims priority to Canadian Patent Application No. 2,823,643, filed on Aug. 12, 2013, which are incorporated by reference as if fully set forth.

BACKGROUND

The present disclosure relates to improvements in apparatus for grinding the hard metal inserts or working tips of rock drill bits (percussive or rotary), tunnel boring machine cutters (TEM) and raised bore machine cutters (RBM) and more specifically, but not exclusively, for grinding the cutting teeth or buttons of a rock drill bit or cutter.

In drilling operations the cutting teeth (buttons) on the drill bits or cutters become flattened (worn) after continued use. Regular maintenance of the drill bit or cutter by regrinding (sharpening) the buttons to restore them to substantially their original profile enhances the bit/cutter life, speeds up drilling and reduces drilling costs. Regrinding should be undertaken when the wear of the buttons is optimally one third to a maximum of one-half the button diameter.

Manufacturers have developed a range of different manual and semi-automatic grinding machines including hand held grinders, single arm and double arm self centering grinding machines and grinders designed specifically for mounting on drill rigs, service vehicles or set up in the shop.

These types of machines utilize a grinding machine having a spindle or rotor rotated at high speed. A grinding cup or grinding pin, mounted on the end of the rotor or spindle, grinds the button and typically the face of the bit/cutter surrounding the base of the button to restore the button to substantially its original profile for effective drilling. In addition to the rotation of the grinding cup, these types of grinding machines may include features where the grinding machine is mounted at an angle to the longitudinal axis of the button and the grinding machine is rotated to provide orbital motion with the center of rotation lying in the center of the grinding cup. When grinding the buttons, the centering aspects of the grinding machine tend to center the grinding machine over the highest point on the button.

The conventional grinding machines switch between grinding pressure and balance pressure to achieve the desired effect. In conventional grinding machines, the minimum grinding pressure is equivalent to the weight of the arm or lever section and the components attached to it.

Longstanding problems with these types of grinding machines are vibration and noise due to high rotational speeds, wear, the requirement for large compressors for pneumatic systems and long grinding times per button, in the larger sizes.

U.S. Pat. No. 7,402,093 addressed a number of problems with earlier machines and provided a grinding machine carried on a support system where the grinding cup is rotated at variable speeds preferably from about 2200 to 6000 RPM and the support system is capable of providing a variable feed pressure preferably or optionally up to 350 kilos. In this type of machine there is a need to control the feed pressure with precision.

SUMMARY OF THE INVENTION

Accordingly the present disclosure provides embodiments of a grinding apparatus for grinding the hard metal inserts of rock drill bits. The grinding apparatus has a grinding machine carried on a support system and means for holding one or more bits to be ground. The grinding machine is equipped with a grinding cup driven by a motor to rotate about its longitudinal axis. The support system comprises an arm or lever system to control movement of the grinding machine for alignment of the grinding machine with a hard metal insert to be ground, means to provide grinding pressure, means to monitor and control one or more operational functions of the grinding apparatus selected from the group consisting of force, grinding pressure, movement and speed of movement of the grinding machine during alignment with a hard metal insert. The means to monitor and control one or more functions of the grinding apparatus includes one or more load cells to quantify and measure forces being applied during said one or more functions and a programmable control system capable of monitoring and adjusting the one or more functions based on input from the one or more load cells.

In one embodiment the means to provide grinding pressure is a linear actuator pivotally connected to the arm or lever system to produce forces such as feed (grinding) pressure and a load cell to quantify and measure the force being applied during grinding. The combination of control system, linear actuator and load cell allow for feed (grinding) pressure to start from zero. This differs significantly from conventional grinding machines as the minimum feed pressure in conventional grinding machines is equal to the weight of the grinding machine and support system.

Another aspect of the present disclosure relates to embodiments of grinding apparatus wherein means for holding one or more rock drill bits to be ground are provided that include a moveable pressure plate for each aperture and movement of said pressure plate is controlled by a linear actuator.

A further aspect of the present disclosure relates to embodiments of grinding apparatus having a water and waste collection system for recovery of coolant and metal removed from the hard metal inserts during grinding.

Further features of the invention will be described or will become apparent in the course of the following detailed description.

BRIEF DESCRIPTION OF THE DRAWINGS

In order that the disclosure may be more clearly understood, the embodiments will now be described in detail by way of example, with reference to the accompanying drawings, in which.

DETAILED DESCRIPTION

Figure 1:
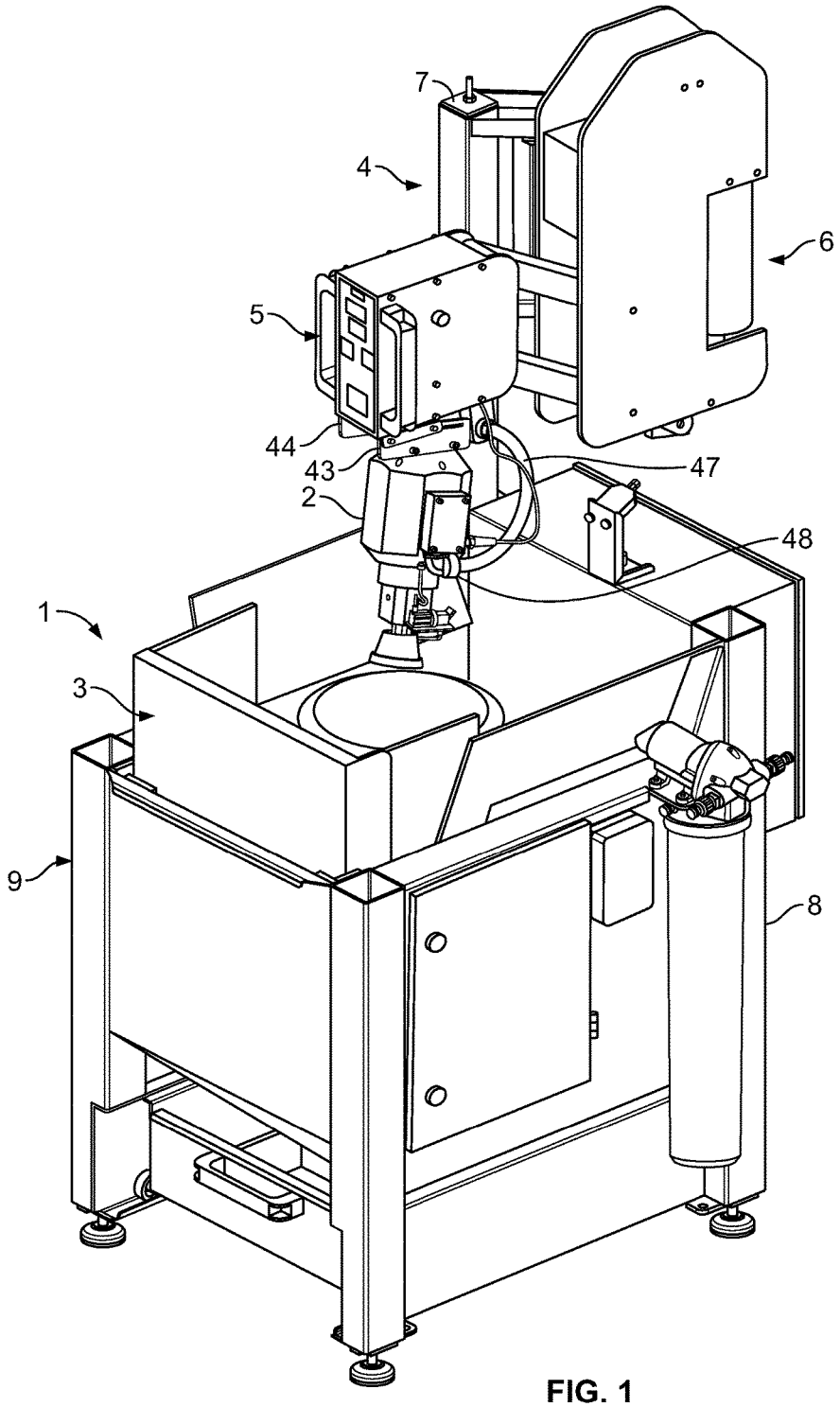
FIG. 1 is perspective view from the right side of one embodiment of a grinding apparatus according to the present disclosure having a grinding machine carried for vertical and horizontal adjustment by a support system, and means for holding the bit(s) to be ground and with a schematic illustration of a large down the hole bit (the bit illustration does not show the hard metal inserts or buttons to be ground).
Figure 2:
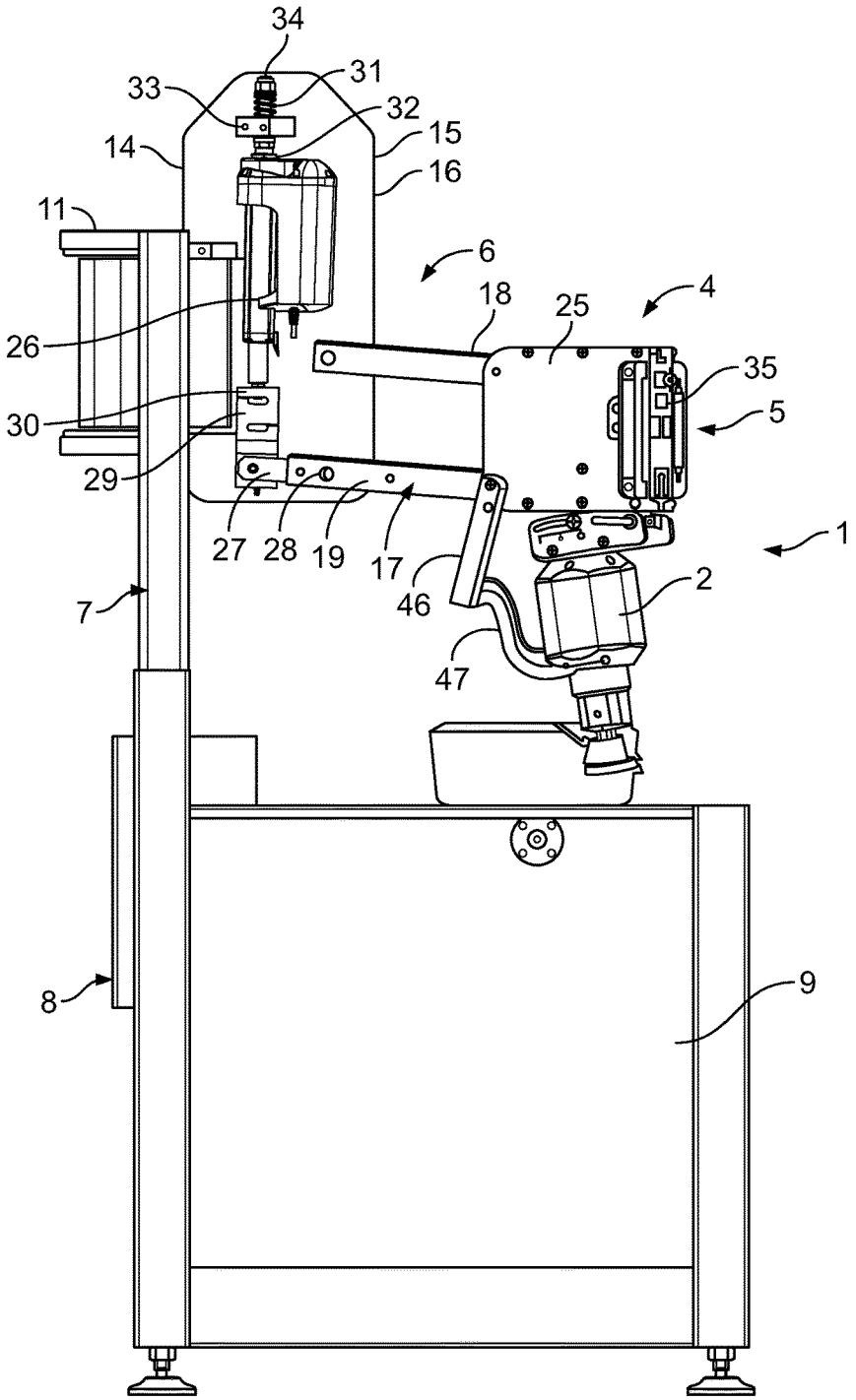
FIG. 2 is left side view the grinding apparatus of FIG. 1 with shielding removed around the bit.
Figure 3:
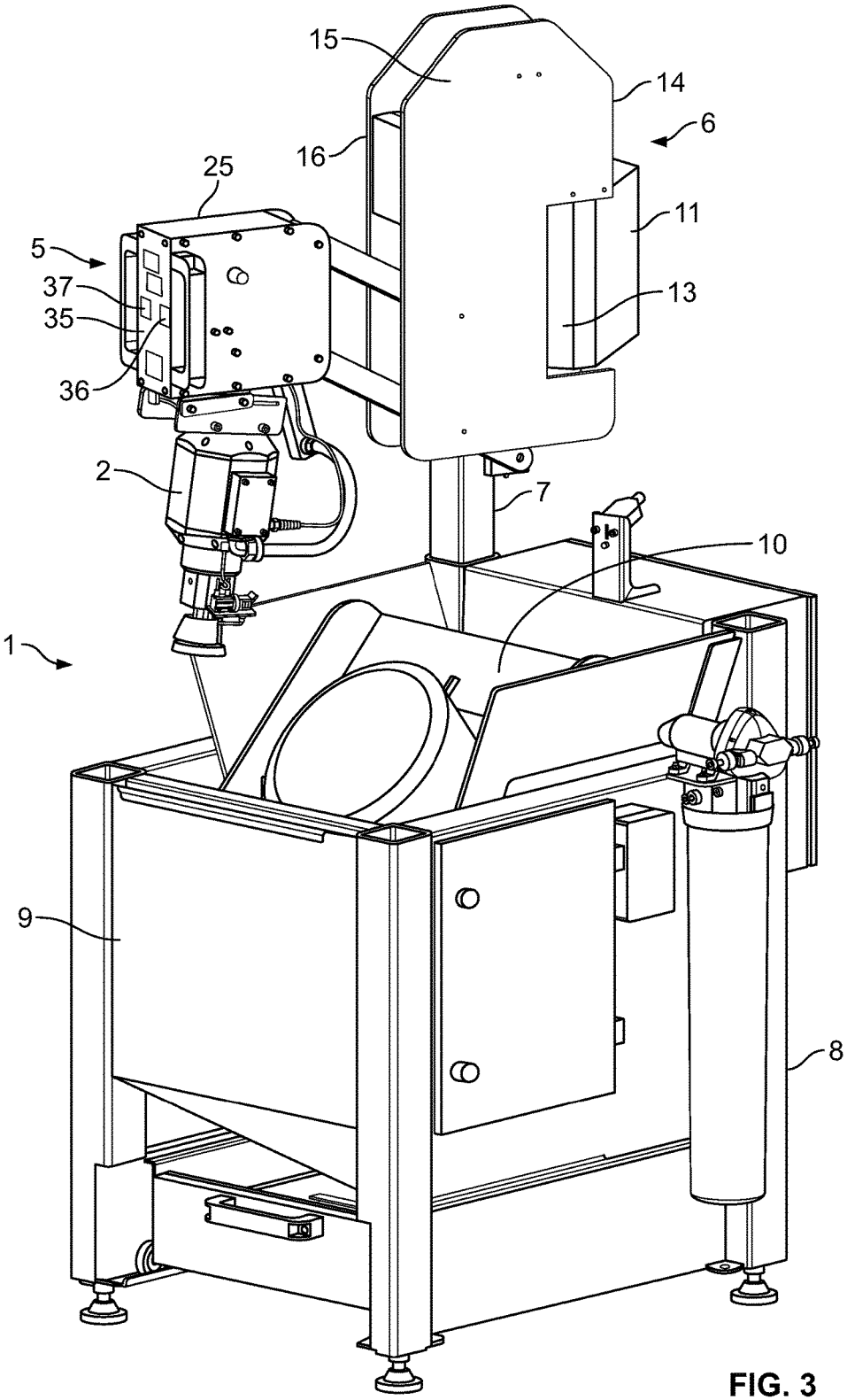
FIG. 3 is perspective view from the right side of the grinding apparatus of FIG. 1 with the bit table rotated.
Figure 4:
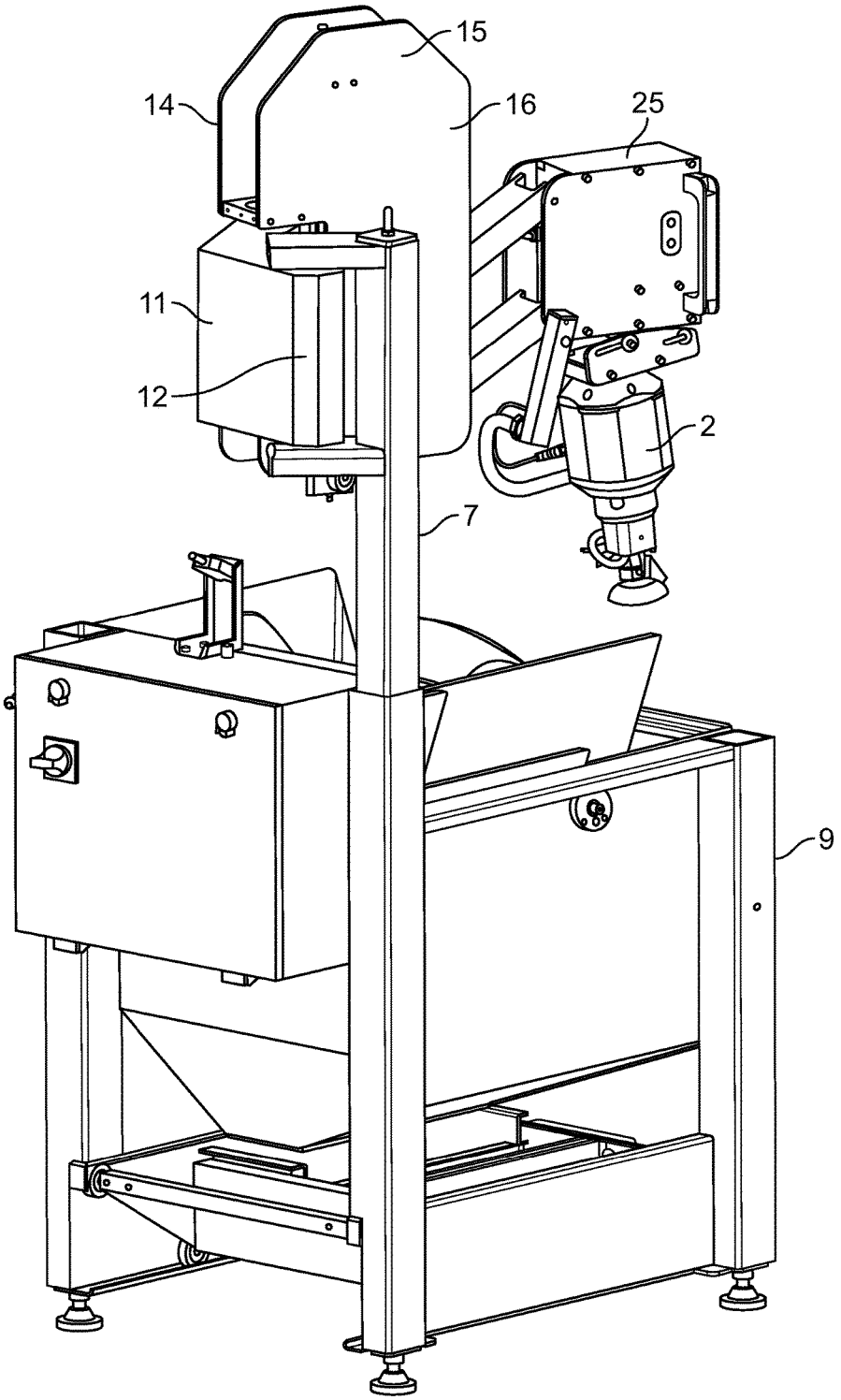
FIG. 4 is rear perspective view from the left side of the grinding apparatus of FIG. 3
Figure 5:
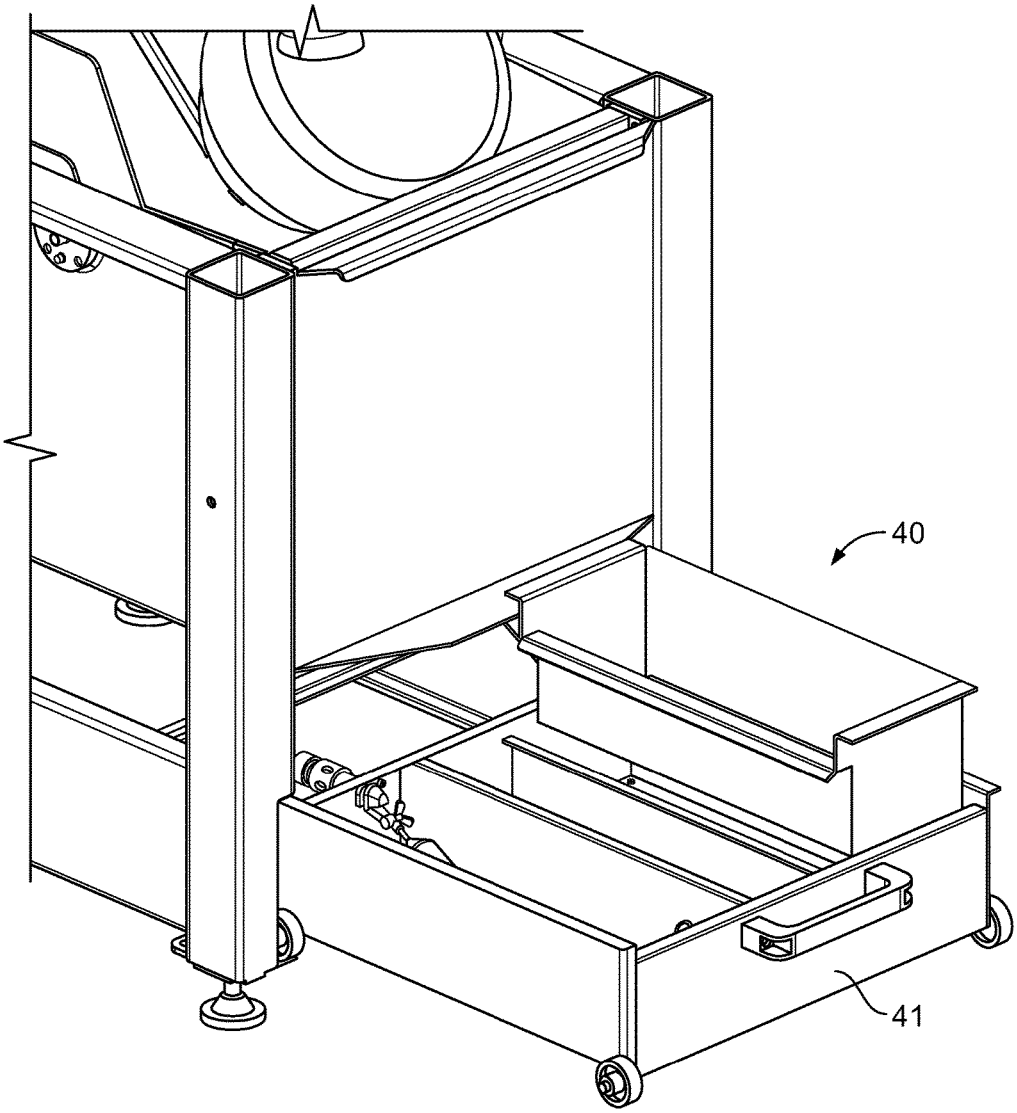
FIG. 5 is an enlarged perspective view of the water and waste collection system forming part of the grinding apparatus of FIG. 1.
Figure 6:
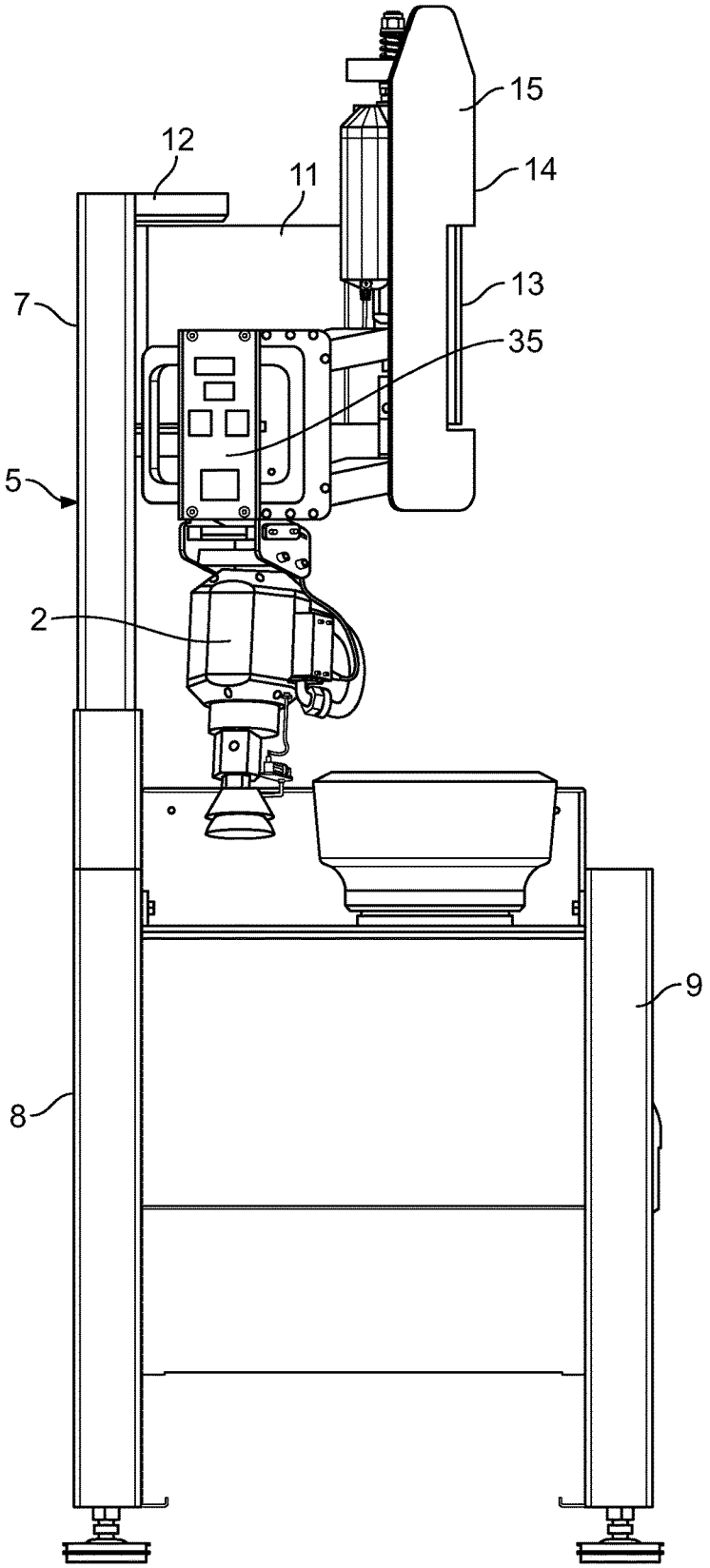
FIG. 6 is frontal view of the grinding apparatus of FIG. 1 with shielding removed.
Figure 7:
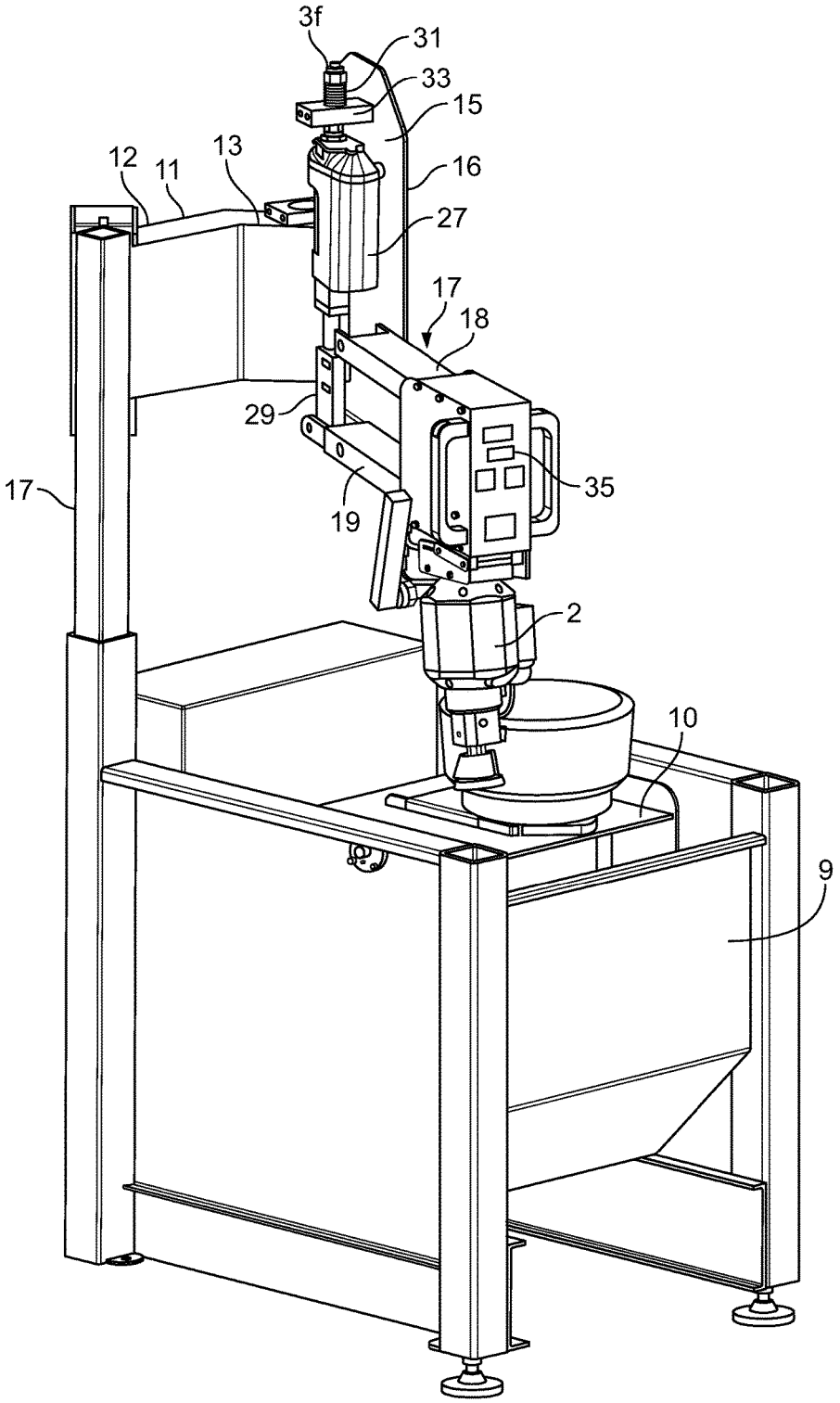
FIG. 7 is a perspective view of the grinding apparatus of FIG. 1 with the content of the first arm section and control box exposed.

With reference to the FIGS. 1 to 12 one embodiment of a grinding apparatus according to the present disclosure is generally indicated at 1. The grinding apparatus 1 includes a grinding machine 2, means for holding one or more bits to be ground generally indicated at 3 and a support system generally indicated at 4. The grinding machine 2, means for holding the bits 3 and support system 4 are arranged to permit relative movement between the grinding machine 2 and the bit to be ground to permit alignment of the grinding machine 2 with the longitudinal axis of the buttons on the bit. The grinding apparatus 1 has a control system, part of which is generally indicated at 5, having a programmable operator control panel 35 capable of directly or indirectly monitoring and adjusting one or more operational parameters. The operational parameters may include feed pressure, grinding cup RPM, grinding time and other parameters as noted herein.

In the embodiment of the grinding apparatus 1 shown in FIGS. 1-12, the grinding machine 2 is carried by support system 4 which includes an arm or lever system 6 journaled on a stand 7 attached to the rear 8 of an open box 9. The bit holder means 3 consists of a table 10 mounted within the box 9.

In the embodiment shown, the arm or lever system 6 for carrying and positioning the grinding machine 2 as noted previously is journaled onto a stand 7 at the rear 8 of the box 9. The arm system 6 consists of a first arm section 11 having one end 12 journaled to the stand 7. The other end 13 of the first arm section 11 is journaled to the backside 14 of a first control box 15. The first arm section 11, in this embodiment, controls the horizontal location of the grinding machine 2 relative to the bit to be reground. To the front side 16 of the first control box 15 is pivotally mounted a second arm section 17. The second arm section 17 consists of a pair of parallel arms 18,19 with one end 20,21 of each arm 18,19 pivotally mounted to the front side 16 of the first control box 15. The other end 22,23 of each arm 18,19 is pivotally connected to the backside 24 of a second control box 25. The second arm section 17 controls the vertical movement of the grinding machine 2 up and down.

Within the first control box 15 (FIG. 9), is means to provide a balance pressure to the portion of the support system that controls the movement of the grinding machine 2 in the direction of the longitudinal axis of the button or bit when not in use and feed (grinding) pressure when in use. In the embodiment shown, the means to provide grinding pressure is an actuator, generally indicated at 26, pivotally connected to an end 27 of the lower arm 19 of the second arm section 17. The end 27 of lower arm 19 extends out from the pivot point 28 at which the lower arm 18 is connected to the first control box 15. In the embodiment illustrated the actuator is an electro-mechanical linear actuator having a screw 38 whose length and speed of travel is controlled by an electric motor 39. The advantage of using and electro mechanical actuator powered by an electric motor is that it potentially allows for elimination of alternatives such as pneumatic or hydraulic actuators, generally simplifying assembly of grinding apparatus, increasing control and precision of relevant functions, while potentially reducing cost of manufacture. Installation and operation is also simplified as the power source required to operate the grinding apparatus is potentially reduced to electric powered only.

In conventional grinding machines use of high feed forces could potentially cause the grinding machine to fall off the button with great force. In the present disclosure to produce the high feeds safely, and control the feed pressure, control system, generally indicated at 5, is provided to monitor and control one or more operational functions of the grinding apparatus including feed or grinding pressure. Other functions monitored and controlled may include forces applied during retention of the bit in the bit holder means, movement of the grinding machine, speed of movement of the grinding machine during alignment with a hard metal insert. In the embodiment illustrated the control system includes one or more load cells to quantify and measure forces being applied during the functions of the grinding apparatus including speed of actuator movement, feed pressure, etc. Where the load cell signals a reduction in force, possibly due to the grinding cup moving off the button being ground, the output signal from the load cell may if desired cause the grinding operation to shut off or the electro mechanical actuator to reverse, in order to prevent or minimize a dangerous situation. Load cells measuring operator input and connected to control system 5 allow for force applied on one or more operator inputs such as on handles etc to be translated to, for example, variable speed of movement of electro mechanical actuators. This allows for a programmable control system 5, that is capable of monitoring and adjusting the functions of the grinding apparatus based on input from one or more load cells. In the embodiment illustrated for monitoring and controlling the feed pressure a load cell 29 is provided between the end 30 of the screw 38 of the linear actuator 26 and the end 27 of lower arm 19. The load cell 29 measures the feed pressure of the grinding machine 2 against the drill bit. An output signal from the load cell 29 is directly or indirectly delivered to the control system 5. The control system 5 controls the movement of the screw 38 of linear actuator 26 through the motor 39 and thereby controls the feed pressure.

To accommodate the fact that the surface of the button to be ground may be worn unevenly, means generally indicated at 42, are provided to enable the grinding machine 2 to move slightly during grinding over the uneven button surface without adjustment by the linear actuator. This facilitates a more even and controlled grinding action and reduces load spikes within the grinding apparatus 1 that includes a grinding machine 2, means for holding one or more bits to be ground generally indicated at 3 and a support system generally indicated at 4. In the embodiment illustrated the end 32 of linear actuator 26 remote from the second arm section 17, is adapted to fit within a hole through block 33 at the point of connection to the first control box 15. A spring 31 around the portion of the linear actuator 26 extending through block 33 is biased against the block 33 by nut 34. The spring 31 may be compressed and decompressed similar to a shock absorber to permit the grinding machine 2 to move slightly over the uneven button surface without adjustment of linear actuator 26. As noted above, it is also possible where the grinding machine moves over and off the button surface during grinding the output signal from the load cell will warn the operator and the machine may automatically shut down or linear actuator reversed as desired.

Within the second control box 25 is a rotation motor, gear box and gear for providing an orbital rotation to the grinding machine 2. The grinding machine 2 is attached to the second control box 25 by means of a pair of plates 43,44. Each of the plates 43,44 is provided with an accurate slot 45. The angle of attachment of the grinding machine 2 relative to the control box 25 can be adjusted by means of slots 45. By having the grinding machine 2 slightly off vertical, nipple formation on the button being reground is minimized and uneven wear on the grinding cup avoided.

A conduit 46 at the rear of control box 25 is used to deliver power, water and/or air feeds to grinding machine 2 without being tangled in the orbital rotation of the grinding machine 2. The remote end of conduit 46 is connected to a flexible conduit 47 that connects to grinding machine 2 through connector 48.

Operator input panel 35 on control box 25 can also be used to set for example button size, grinding time, type of buttons, button wear, percentage of biased side load and feed pressure. The control system may be programmed with preset default values. Start button 36 and stop button 37 are provided on panel 35.

The grinding machine 2 illustrated in the FIGURES utilizes a hex drive system of the type described in U.S. Pat. No. 5,639,273 and U.S. Pat. No. 5,727,994.

A programmable control card is provided within the second control box 25 optionally attached to rear of operator input panel 35, having a circuit board containing the central processor (ie. microprocessor or microcontroller) for the control system of the grinding apparatus. The central processor can be located anywhere deepend suitable for the application and can be suitably interconnected with other sub-processors to monitor various functions as deemed necessary for proper function. The overall control system includes systems and controls that together with a microprocessor or microcontroller can control all aspects of the grinding apparatus including grinding time on each button, rotational speed of the grinding cup, grinding pressure, bit holder tilt function, operating lights and coolant flow. The microprocessor or microcontroller and the control system can be used to provide other functions either manual or automatic. For example, the microprocessor or microcontroller and control system, in the case of an electric motor, can monitor the amperage being used and/or the temperature and if it reaches a preset limit automatically decrease the grinding pressure to prevent motor burn out. The microprocessor or microcontroller and control system can also control the flow of coolant to the face of the button during grinding.

In addition, the control panel software can be configured such that the user could select for example whether long grinding cup life or high material removal rate of the grinding cup is preferred.

Figure 16:
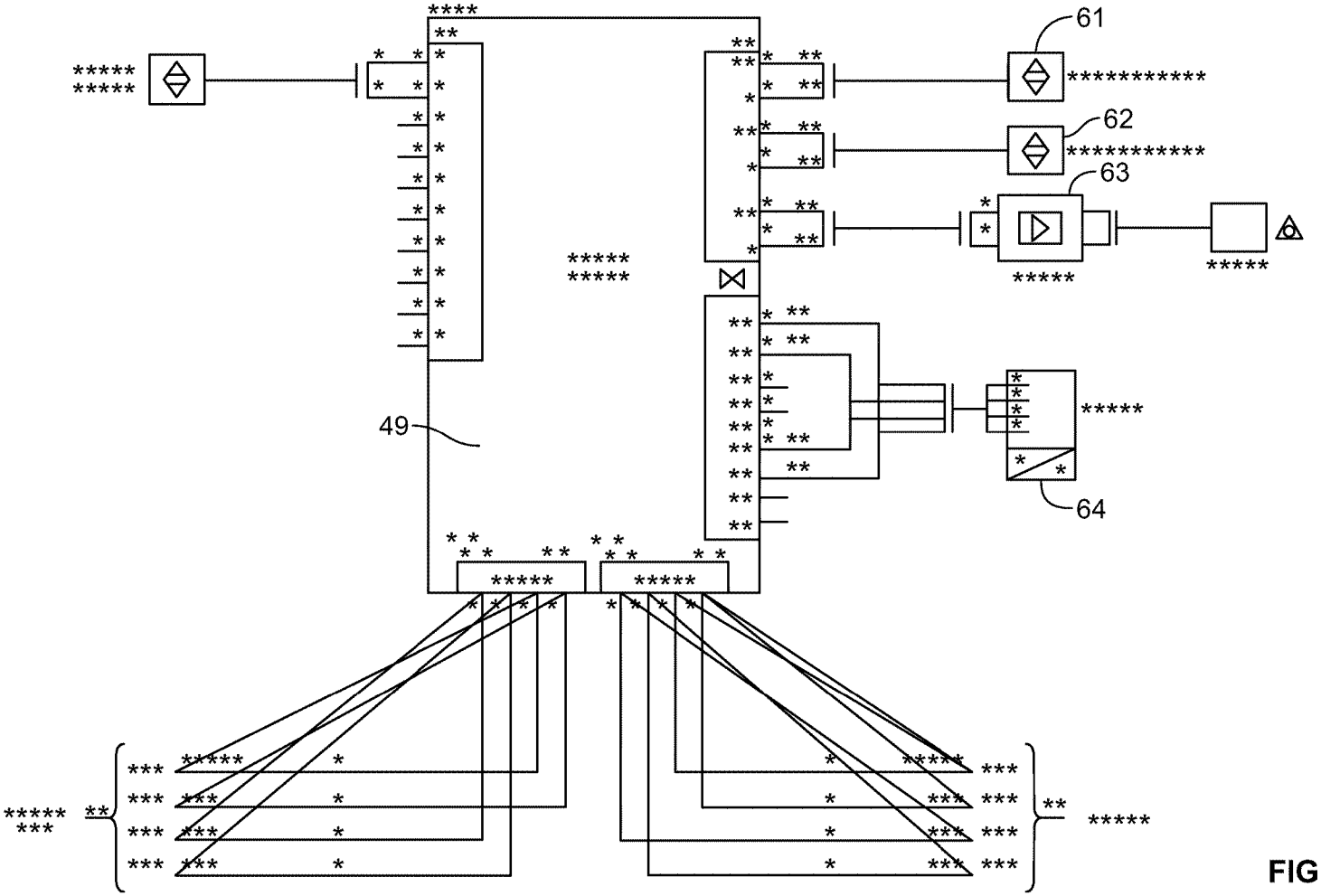
FIG. 16 is a schematic drawing of a part of a circuit diagram for one embodiment of a control system in accordance with one embodiment of the present disclosure.
Figure 17:
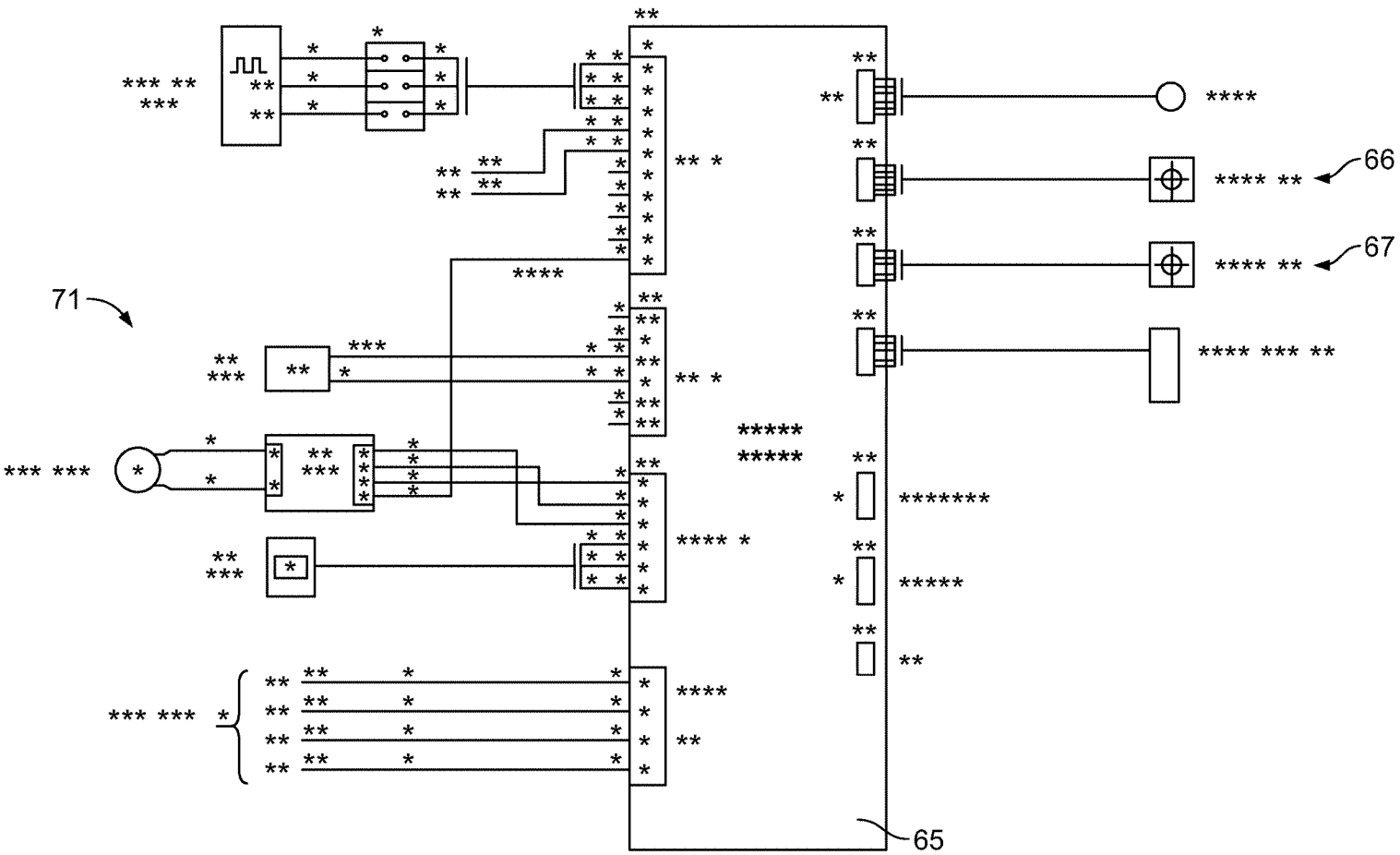
FIG. 17 is a schematic drawing of another part of a circuit diagram for the control system of FIG. 16.
Figure 18:
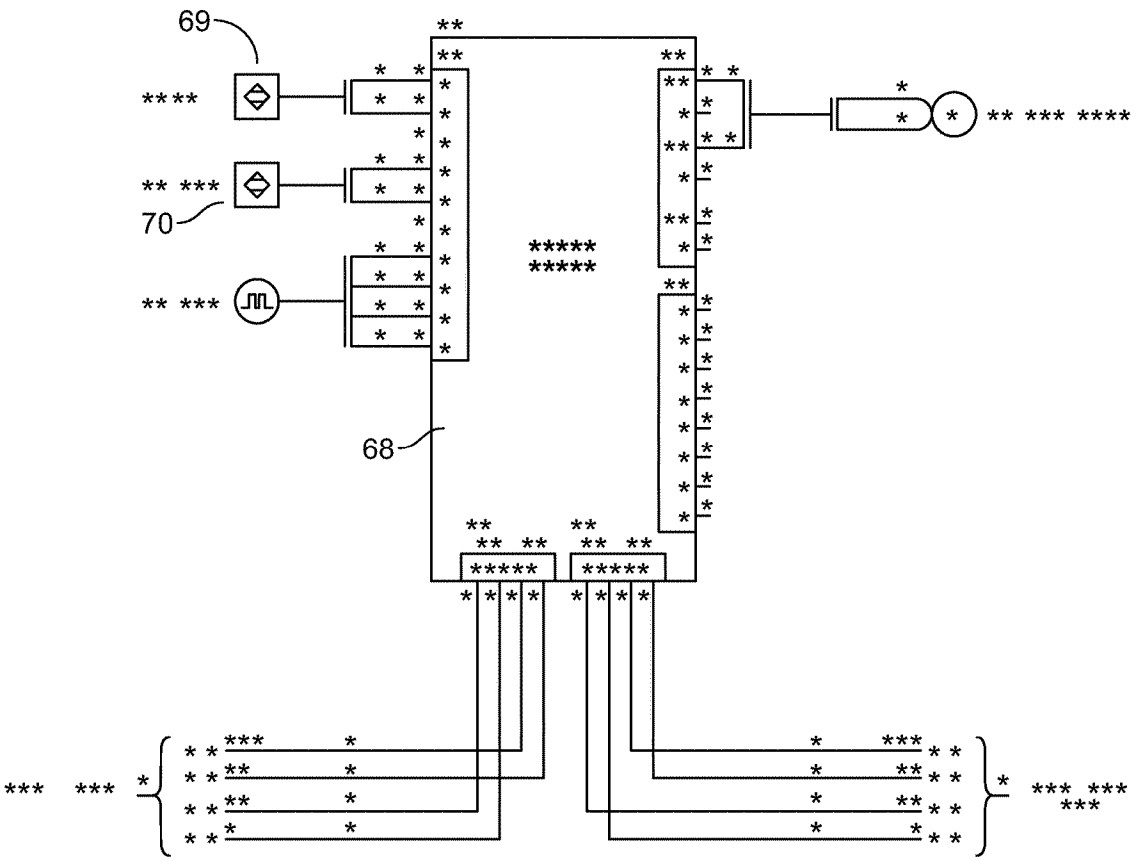
FIG. 18 is a schematic drawing of another part of a circuit diagram for the control system of FIG. 16.
Figure 19:
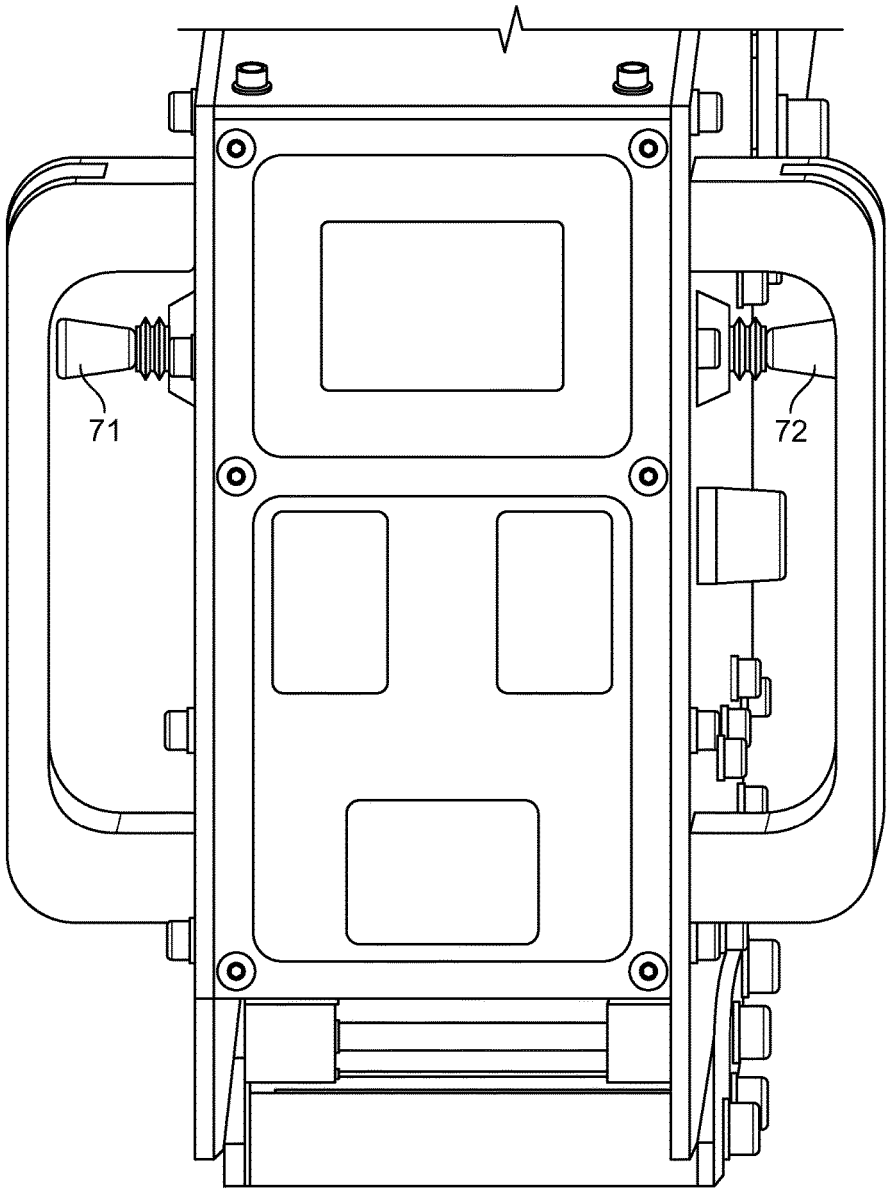
FIG. 19 is an embodiment of a control panel using the circuitry of FIG. 16 with joysticks.

FIGS. 16-18 illustrate schematically one embodiment of part of a circuit diagram for a control system according to the present disclosure. In FIG. 16 an input/output card 49 is schematically illustrated with circuit inputs for grinding pressure 61, the splash guard control 62, laser drive 63 and milling pressure 64, In FIG. 17 an input/output card 65 is schematically illustrated with circuit inputs 66, 67 for controlling the joystick and orbital rotation of the grinding machine. IN FIG. 19 a control panel is illustrated with joysticks 71,72. the joysticks as either an alternative to load cells measuring operator input or as means to achieve two-hand control for when deemed necessary for reasons such as safety, etc. The joysticks may be used to scroll down the menu as well as select various functions. Two-hand control of things like bit holder tilt function may be achieved by requiring that the operator move both joysticks to activate the desired function. The use of a combination of joystick and load cell could also be used to achieve certain controlled functions whenever required. In FIG. 18 an input/output card 68 is schematically illustrated with circuit inputs for controlling linear actuator with inputs 69 and 70.

Figure 20:
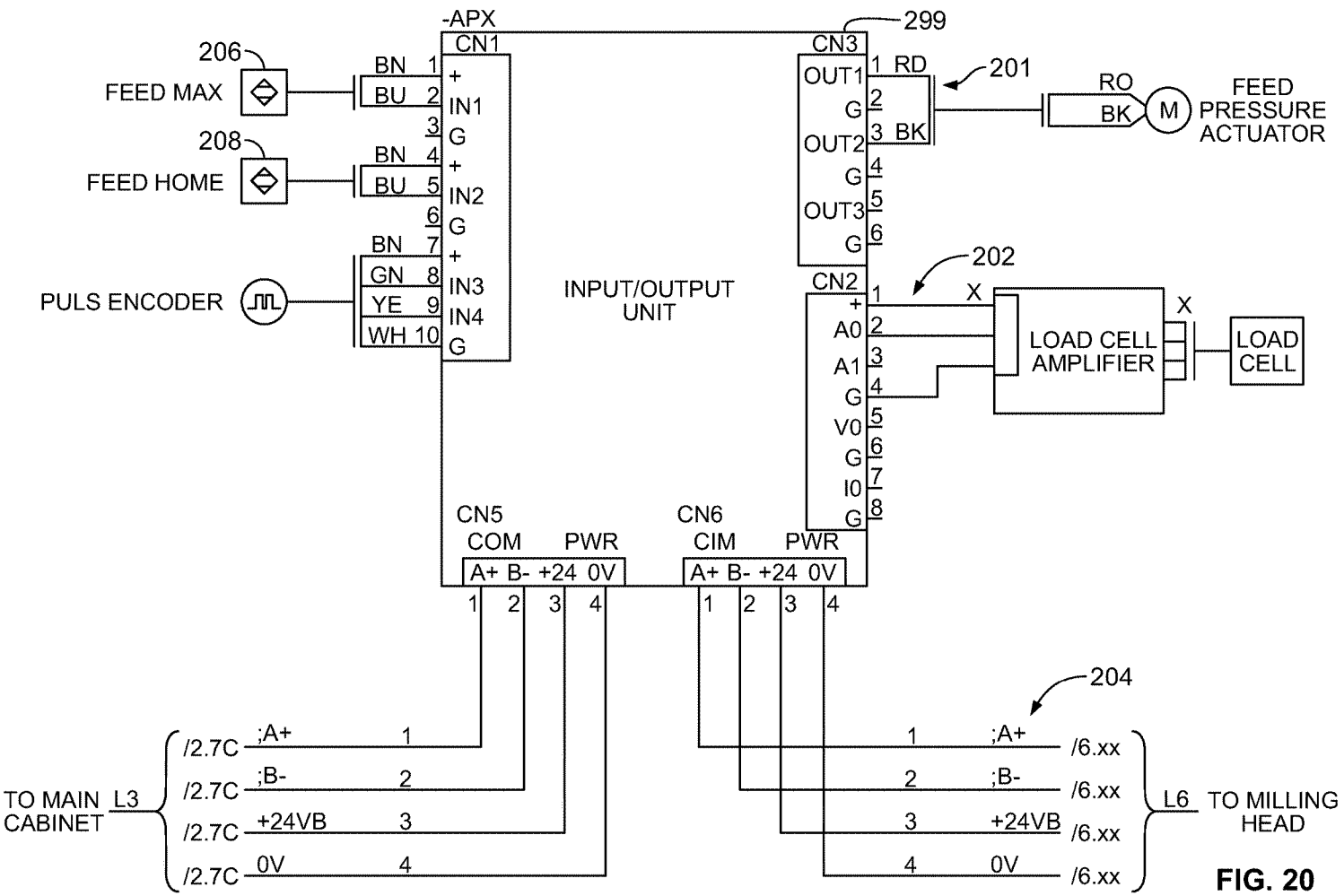
FIG. 20 is a schematic drawing of a part of a circuit diagram for another embodiment of a control system in accordance with the present disclosure.

FIG. 20 illustrates schematically another embodiment of part of a circuit diagram for a control system according to the present disclosure. In FIG. 20 an input/output card 299 is schematically illustrated with circuit inputs for feed pressure actuator 201, load cell amplifier/load cell 202, milling head 104 and joystick controls 206, 208 and orbital rotation of the grinding machine. In FIG. 20, a load cell amplifier is illustrated. The load cell amplifier optimizes the input to the load cell. The load cell amplifier is optional and can be used to optimize the input to the load cell if desired and can be a separate device or built into the load cell.

Variations of the above described principles including increased feeds/grinding pressure, lower grinding cup RPM, water cooled motor, using frequency inverters, biased side loads, counter balancing and position fixing, that can optionally be used to allow for grinding at angles other than vertical, are within the scope of the present invention. Combinations of variations of the above described principle of increased feeds/grinding pressure, lower grinding cup RPM, water cooled motor, using frequency inverters, biased side loads, counter balancing and position fixing can be used to substantially eliminate the need for tilting/pivoting the bit when switching between grinding of face buttons and gauge buttons. Some of the above principles could also be applied to for example pneumatically and/or hydraulically powered motors. In addition on existing air-cooled motors, spindle speed can be varied using a gear box arrangement between the motor output and the spindle drive input to reduce spindle RPM, optionally variable, up to 45% or more.

During grinding a coolant, typically water, is sprayed onto the button being ground. The grinding apparatus shown may include a water and waste collection system generally indicated at 40 in FIG. 4. The Water and waste collection system includes drawer 41 that can be moved into position below the open box 9. The excess coolant water and metal removed from the buttons during grinding are collected in drawer 41 permitting the water to potentially be recycled back into the coolant system.

Figure 8:
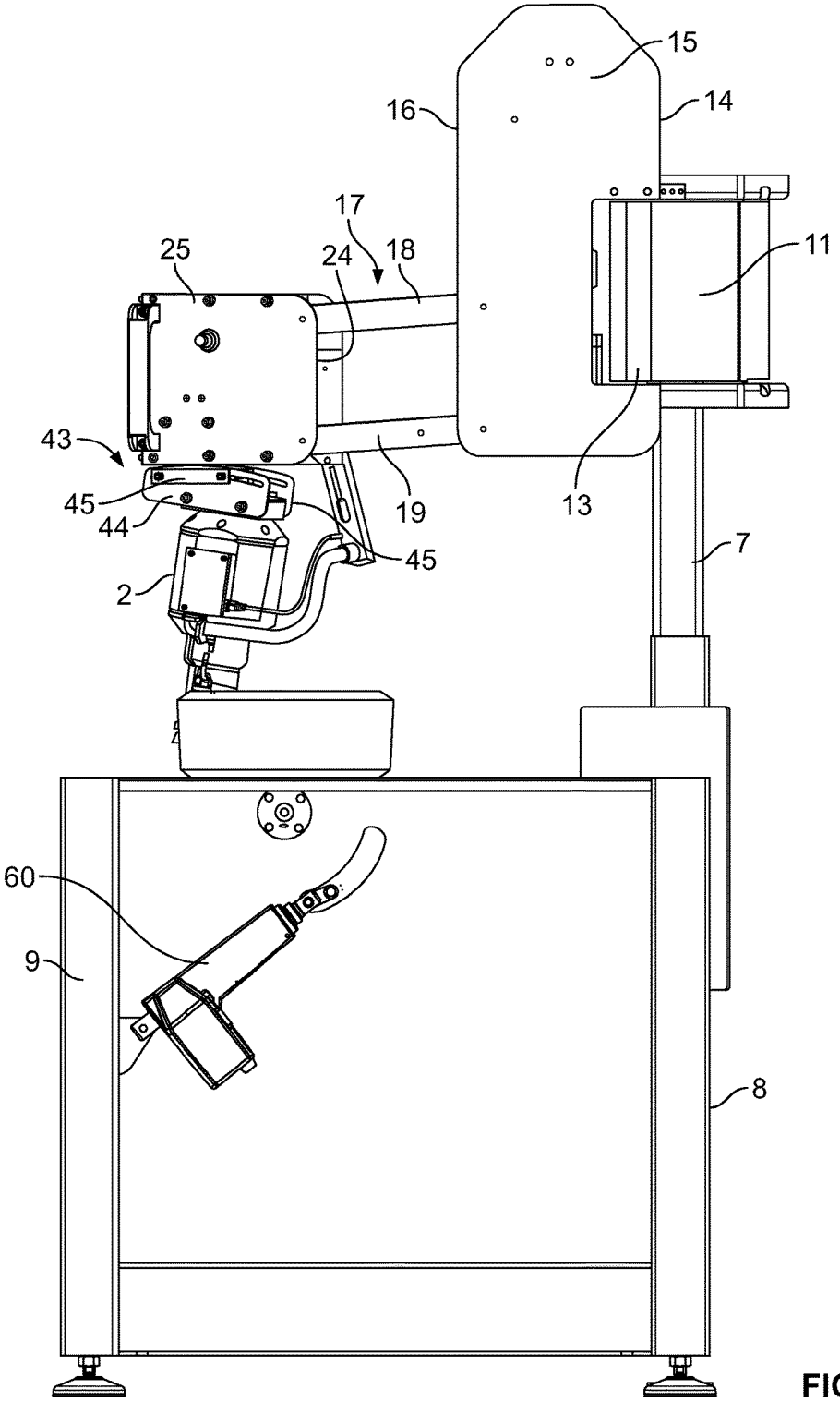
FIG. 8 is a right side view of the grinding apparatus of FIG. 7.
Figure 9:
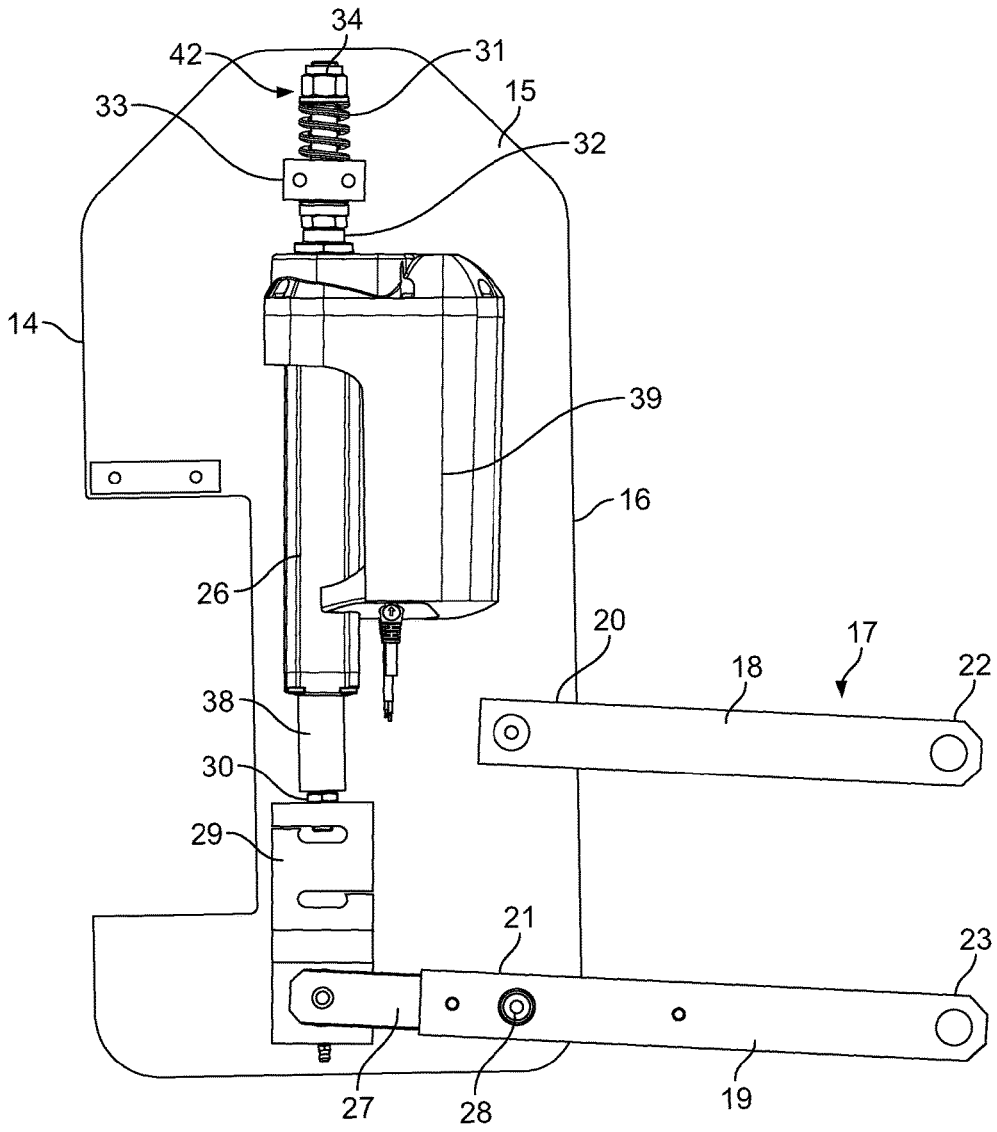
FIG. 9 is an internal side view of the first box section and second arm section of the support system of FIG. 1.
Figure 10:
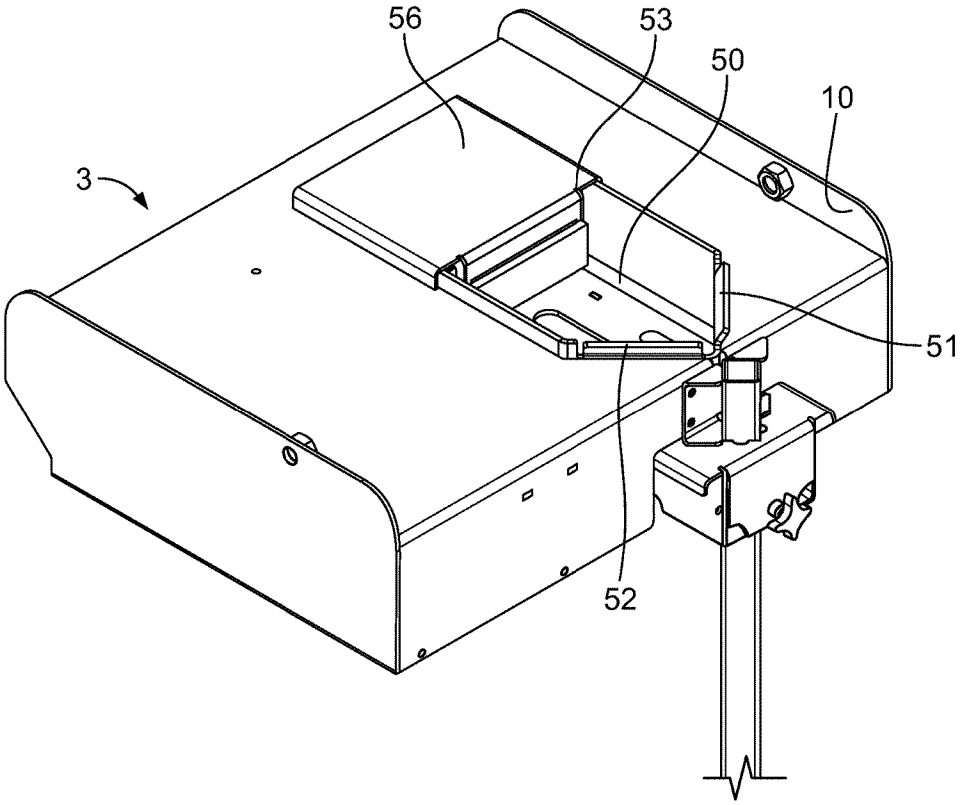
FIG. 10 is a top view of one embodiment of bit holder for the grinding apparatus of FIG. 1.
Figure 11:
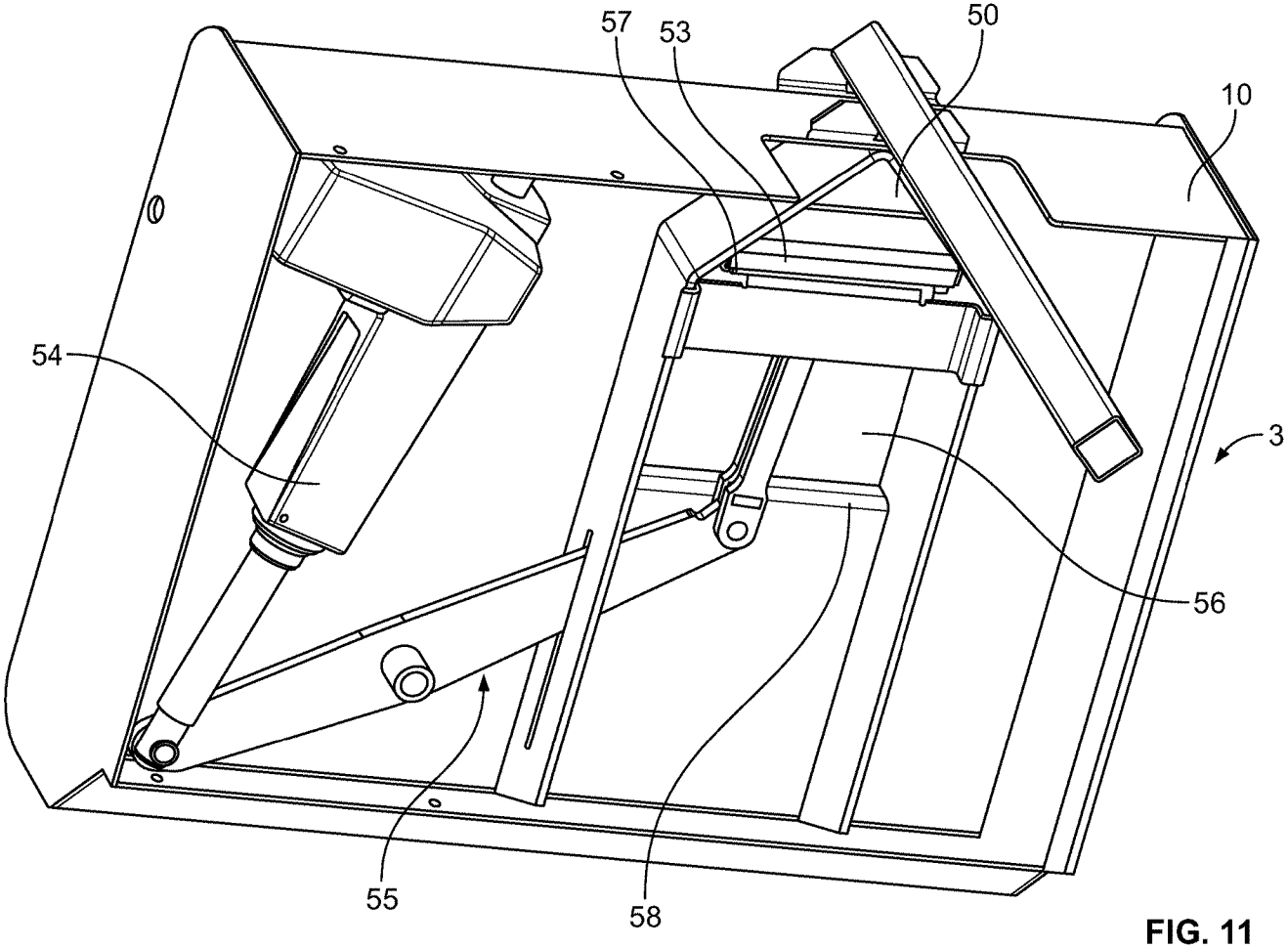
FIG. 11 is a bottom view of the bit holder of FIG. 10 with the aperture closed.
Figure 12:
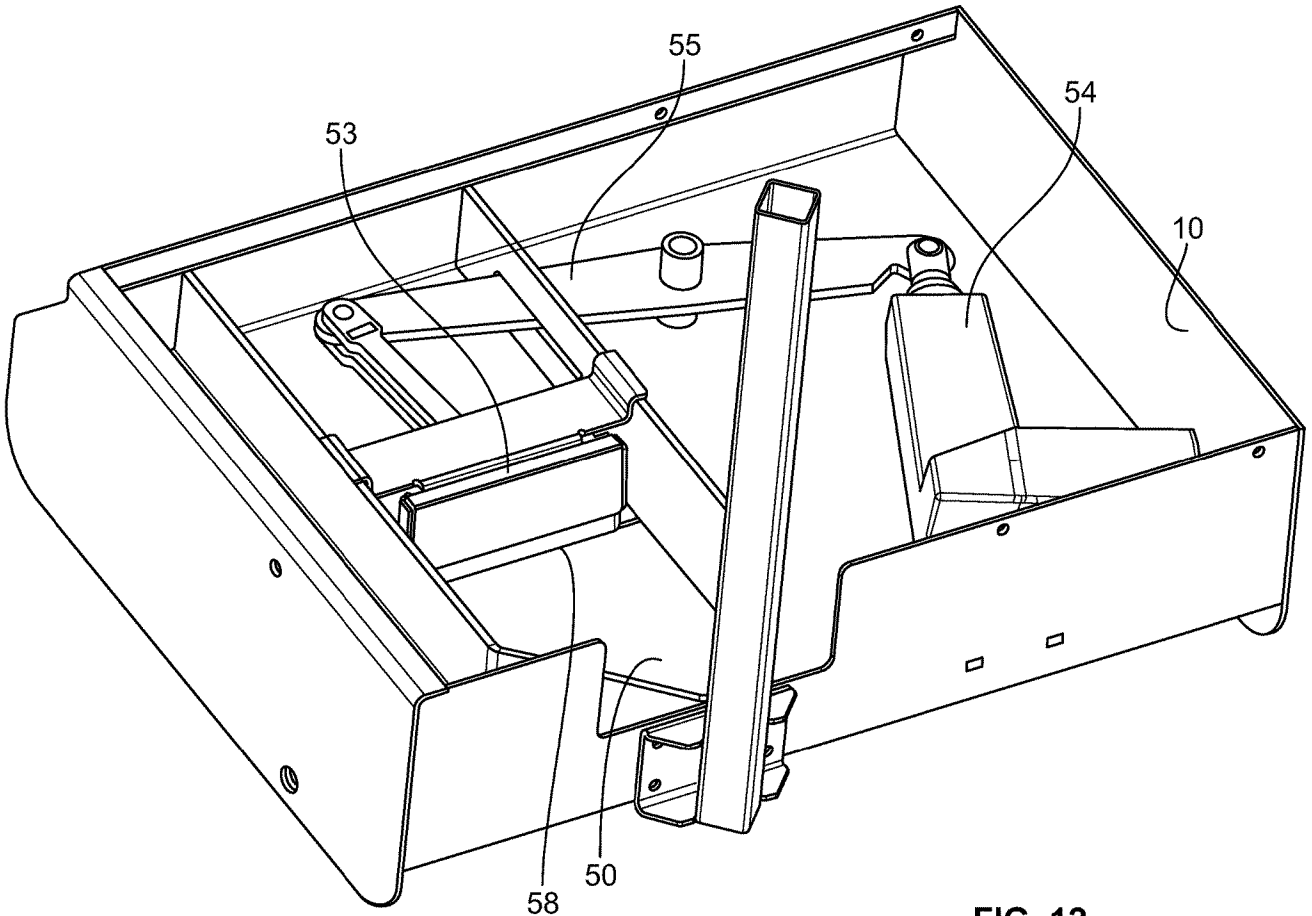
FIG. 12 is a bottom view of the bit holder of FIG. 10 with the aperture open.

In the embodiment illustrated the means for holding the bits 3 is a table 10 mounted within the box 9 at pivot points on each side of the box 9 to permit the table 10 to be tilted. In FIG. 8 a linear actuator 60 is shown as controlling the tilting action of table 10. The bit holder means 3, in this case table 10, may be provided with one or more apertures 50 to hold one or more bits to be ground. In the embodiment illustrated table 10 has one aperture 50 (see FIGS. 10-12). When a bit(s) is positioned in an aperture 50 the shank of the bit is placed against the front edges 51,52 of aperture 50. The front edges 51,52 may be rubber coated. The bit is held in place against front edges 51,52 by pressure plate 53 controlled by a second linear actuator 54 and lever arm assembly 55. Means are provided to monitor and control the travel of the linear actuator. In the embodiment illustrated the linear actuator 54 is an electro mechanical actuator. By monitoring the amperage used by the electric motor for the actuator 54, when the amperage spikes the control system 5 can stop the electric motor from advancing the actuator further. The amperage will spike when the pressure plate 53 contacts the shank of the bit when the shank is contacting front edges 51,52 of aperture 50. A shield 56 is attached to and moves with the pressure plate 53 and fully covers the opening between the rear 57 of pressure plate 53 and back 58 of the aperture 50. The shield 56 prevents accidental pinching of fingers, etc. when the pressure plate 53 is retracted. The linear actuator 54 can be backed off slightly to rotate the bit (to the next button to be ground) within the aperture 50 without full retraction of the linear actuator 54 and pressure plate 53. The controls for operating the linear actuator 54 may be provided on the sides of box 9. While the method of holding a bit in the bit holder means is shown as a pressure plate 53 and linear actuator 54 other arrangements are possible and the present invention is not limited to the embodiment is illustrated.

Figure 13:
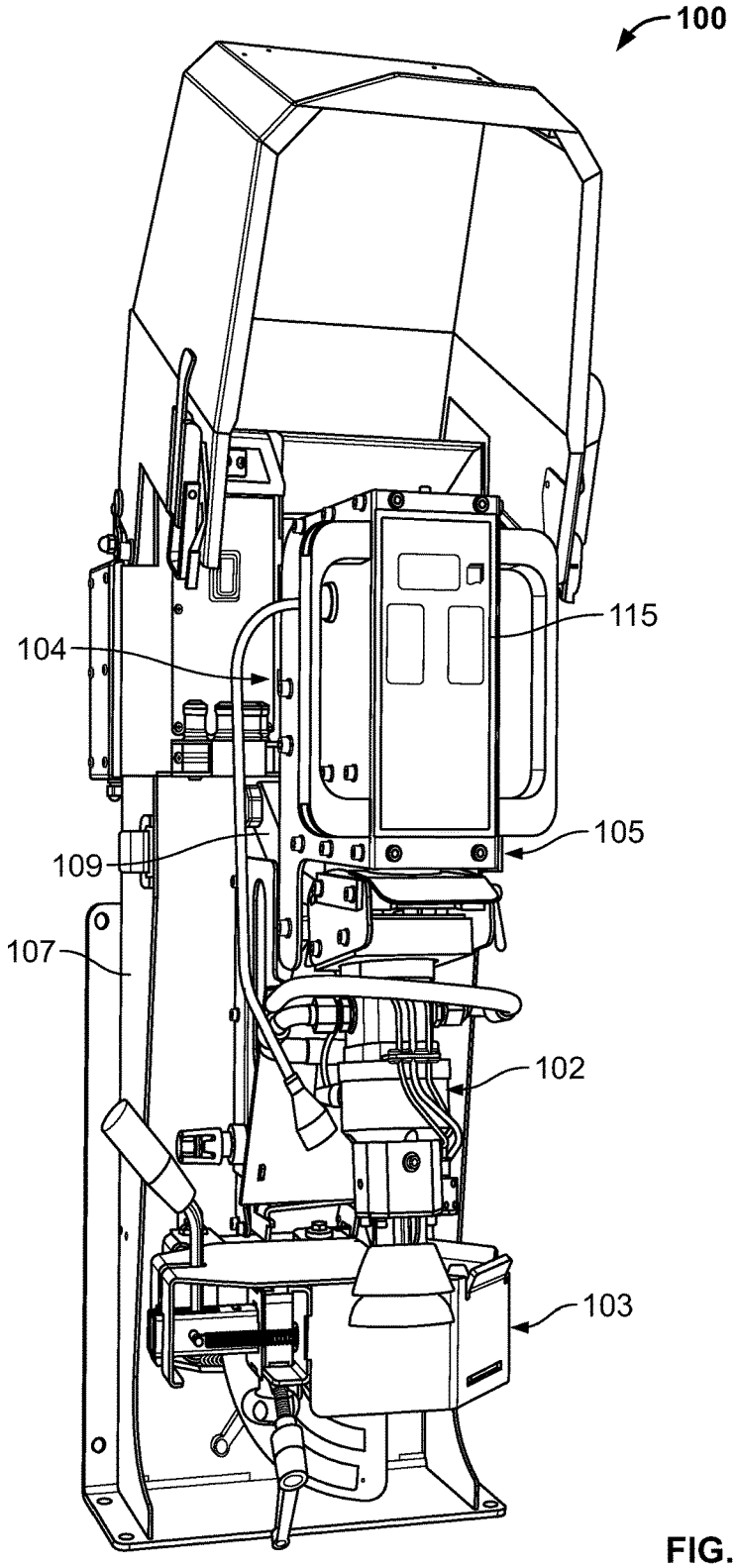
FIG. 13 is perspective view from the left side of another embodiment of a grinding apparatus according to the present disclosure suitable for mobile applications and having a grinding machine carried for vertical and horizontal adjustment by a support system, and means for holding the bit(s) to be ground.
Figure 15:
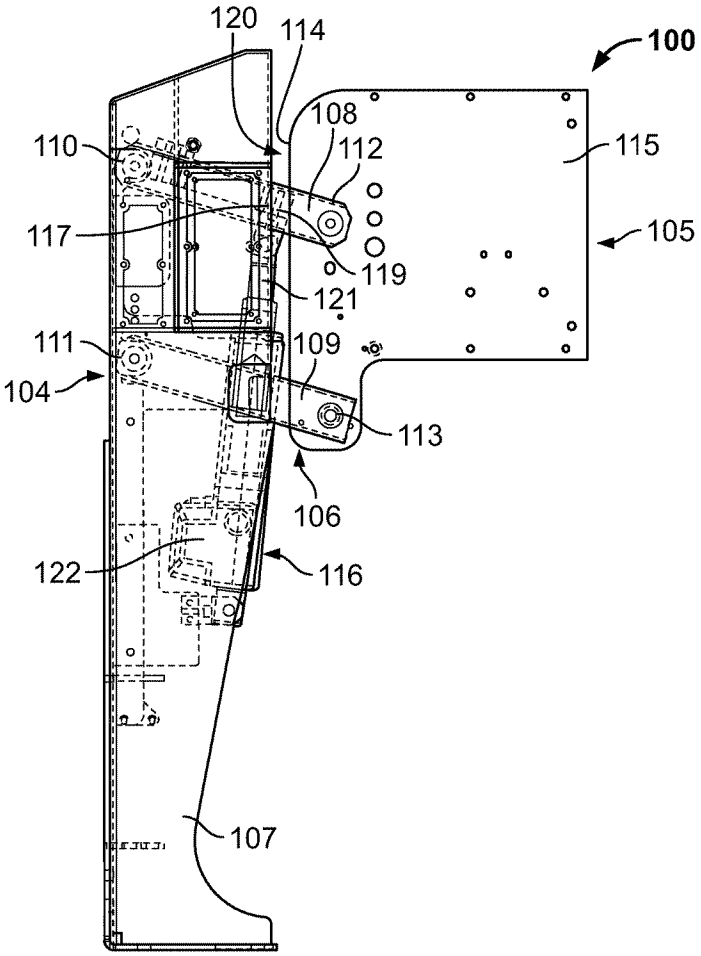
FIG. 15 a side plan view of part of the support system of the grinding apparatus of FIG. 13.
Figure 14:
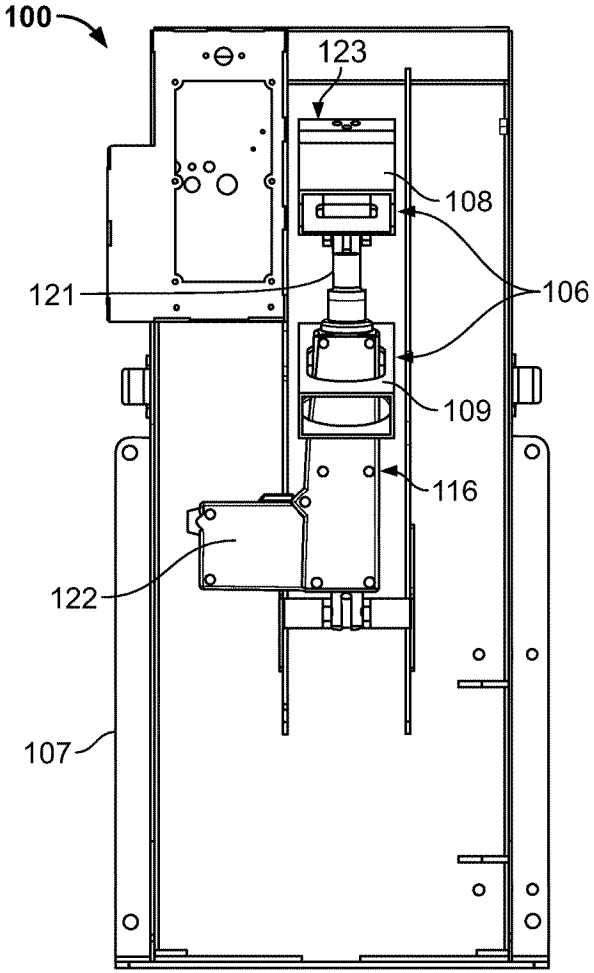
FIG. 14 is a front plan view of part of the support system of the grinding apparatus of FIG. 13.

FIGS. 13 to 15 illustrate another embodiment of a more compact grinding apparatus, according to the present disclosure, optionally suitable for mobile applications. The grinding apparatus is generally indicated at 100. The grinding apparatus 100 includes a grinding machine 102, means for holding one or more bits to be ground generally indicated at 103 and a support system generally indicated at 104. The grinding machine 102, means for holding the bits 103 and support system 104 are arranged to permit relative movement been the grinding machine 102 and the bit to be ground to permit alignment of the grinding machine 102 with the longitudinal axis of the buttons on the bit. The grinding apparatus 100 has a control system, part of which is generally indicated at 105, having a programmable operator control panel capable of directly or indirectly monitoring and adjusting one or more operational parameters. The operational parameters of most interest are selected from the group consisting of feed pressure, grinding cup RPM and grinding time.

In the embodiment of the grinding apparatus 100 shown the grinding machine 102 is carried by support system 104 which includes an arm or lever system 106 attached to the frame 107.

In the embodiment shown, the arm or lever system 106 for carrying and positioning the grinding machine 102 as noted previously is attached to the frame 107. The arm system 106 consists of a pair of parallel arms 108,109 with one end 110,111 of each arm 108,109 pivotally mounted to the frame 107. The other end 112,113 of each arm 108,109 is pivotally connected to the backside 114 of a control box 115. The arm system 106 controls the vertical movement of the grinding machine 102 up and down.

Within the frame 107, is means to provide a balance pressure to the portion of the support system that controls the movement of the grinding machine 102 in the direction of the longitudinal axis of the button or bit when not in use and grinding pressure when in use. In the embodiment shown, the means to provide grinding pressure is an actuator, generally indicated at 116 pivotally connected to the arm 108. In the embodiment illustrated the actuator is a electromechanical linear actuator having a screw whose length and speed of travel is controlled by an electric motor.

As noted high feed forces in conventional self-centering grinding machines could potentially cause the grinding machine to fall off the button with great force. To produce the high feeds safely, and control the feed pressure, means, generally indicated at 120, is provided to monitor and control the feed pressure. In the embodiment illustrated the means to monitor the feed pressure is a load cell 117 provided between the end 118 of the linear actuator 117 and the point of connection 119 to the arm 109. The load cell 117 measures the feed pressure of the grinding machine 102 against the drill bit. A signal from the load cell 117 is delivered to the control system 105. The control system 105 controls the movement of the screw 121 of the linear actuator 116 through the motor 122 and thereby controls the feed pressure. The combination of control system, linear actuator and load cell also allow for feed (grinding) pressure to start from zero. This differs significantly from conventional grinding machines as the minimum feed pressure in conventional grinding machines is equal to the weight of the grinding machine and support system. Where the load cell signals an abrupt reduction in load, possibly due to the grinding cup moving off the button being ground, the control system may be programmed to shut down the grinding operation or other procedure to minimize danger to the operator.

To accommodate the fact that the surface of the button to be ground may be worn unevenly, means generally indicated at 123, are provided to enable the grinding machine 102 to move slightly during grinding over the uneven button surface without adjustment by the linear actuator. In the embodiment illustrated the means to enable the grinding cup to move slightly is provided by the design of the arms 108, 109 to provide some give or flex.

Having illustrated and described a preferred embodiment of the invention and certain possible modifications thereto, it should be apparent to those of ordinary skill in the art that the invention permits of further modification in arrangement and detail and is not restricted to the specific semi-automatic grinding apparatus illustrated.

It will be appreciated that the above description related to the preferred embodiment by way of example only. Many variations on the invention will be obvious to those knowledgeable in the field, and such obvious variations are within the scope of the invention as described and claimed, whether or not expressly described.

The embodiments of the invention in which an exclusive property or privilege is claimed are defined as follows:

1. A grinding apparatus for grinding hard metal inserts of rock drill bits, said grinding apparatus having a grinding machine carried on an support system and means for holding one or more bits to be ground, said grinding machine equipped with a grinding cup driven by a motor to rotate about its longitudinal axis, wherein the support system comprises an arm or lever system to control movement of the grinding machine for alignment of the grinding machine with a hard metal insert to be ground, means to provide grinding pressure, means to monitor and control one or more operational functions of the grinding apparatus selected from the group consisting of force, grinding pressure, movement and speed of movement of the grinding machine during alignment with the hard metal insert, wherein the means to provide grinding pressure includes a linear actuator and a load cell assembly to quantify and measure the force being applied during grinding, the linear actuator and load cell assembly or other part or assembly of the grinding machine further includes means to enable the grinding machine to move slightly during grinding over an uneven surface on the hard metal insert without adjustment of the linear actuator, and a programmable control system to monitor, control and adjust grinding pressure based on input from the load cell by adjusting the speed and length of travel of said linear actuator.

2. A grinding apparatus according to claim 1, wherein said means to monitor and control one or more functions of the grinding apparatus includes one or more additional load cells that quantifies and measures operator input.

3. A grinding apparatus according to claim 2, wherein the linear actuator and load cell are connected to the arm or lever system.

4. A grinding apparatus according to claim 3 wherein the means to enable the grinding machine to move slightly during grinding over an uneven surface on the hard metal insert without adjustment of the linear actuator is a spring assembly to facilitate controlled movement of the grinding machine in relation to the uneven surface on the hard metal insert.

5. A grinding apparatus according to claim 1 wherein the linear actuator is an electro-mechanical linear actuator.

6. A grinding apparatus according to claim 5 wherein the electro-mechanical linear actuator has a screw and motor and the programmable control system controls the motor of the linear actuator to control the speed and length of travel of the screw for the linear actuator in response to input from the load cell.

7. A grinding apparatus according to claim 1 wherein the grinding machine is self-centering about the longitudinal axis of the hard metal inserts.

8. A grinding apparatus according to claim 1 wherein the grinding machine is capable of producing zero feed pressure.

9. A grinding apparatus according to claim 1 wherein the grinding machine utilizes an electric motor.

10. A grinding apparatus according to claim 9 wherein a coolant may be provided to the surface of the hard metal inserts during grinding through one or more outlets in said grinding pin and said electric motor is cooled with the same coolant.

11. A grinding apparatus according to claim 10 having a water and waste collection system for recovery of coolant and metal removed from the hard metal inserts during grinding.

12. A grinding apparatus according to claim 1 wherein said support system for carrying and positioning the grinding machine is journaled onto a stand.

13. A grinding apparatus according to claim 12 wherein said support system has a first arm section having a first end journaled to said stand wherein said first arm section controls the horizontal location of the grinding machine relative to the drill bit to be ground.

14. A grinding apparatus according to claim 13 wherein said arm system has a second arm section having a first end adapted to be connected to a second end of said first arm section, and wherein the second arm section controls the vertical movement of the grinding machine up and down.

15. A grinding apparatus according to claim 14 wherein said support system includes a second arm section.

16. A grinding apparatus according to claim 15, wherein said second arm section has an upper and lower parallel arm with a first end of each arm pivotally mounted to a front side of a first control box, a second end of each arm is pivotally connected to a back side of a second control box wherein the linear actuator and load cell assembly are pivotally connected to a first end of the lower arm said first end of said lower arm extending out from a pivot point at which the lower arm is connected to the first control box.

17. A grinding apparatus according to claim 1 wherein the means for holding one or more rock drill bits to be ground has one or more apertures to hold one or more rock drill bits to be ground, is tiltably mounted within a box or frame and means to control the tilting action.

18. A grinding apparatus according to claim 17 wherein the means for holding one or more rock drill bits to be ground includes a moveable pressure plate for each aperture wherein the shank of a bit is held between said pressure plate and the sides of one of said apertures wherein movement of said pressure plate is controlled by a linear actuator.

19. A grinding apparatus according to claim 18 wherein said support system for carrying and positioning the grinding machine is journaled onto a frame.

20. A grinding apparatus according to claim 19 wherein said support system has an upper and lower parallel arm with a first end of each arm pivotally mounted to a front side of said frame, an a second end of each arm is pivotally connected to a back side of a control box wherein the linear actuator and load cell assembly are pivotally connected to the upper arm.

21. A control system for grinding apparatus for grinding the hard metal inserts of rock drill bits, said grinding apparatus having a grinding machine carried on an support system journaled on a frame and means for holding one or more bits to be ground, said grinding machine equipped with a grinding cup driven by a motor to rotate the grinding cup about its longitudinal axis, wherein the support system comprises an arm or lever system to control movement of the grinding machine for alignment of the grinding machine with a hard metal insert to be ground and means that provides a feed pressure for said grinding machine during grinding, wherein the means to provide feed pressure is a first actuator connected to the arm or lever system and the support system has an upper and lower parallel arm with a first end of each arm pivotally mounted to a front side of said frame, and a second end of each arm is pivotally connected to a back side of a control box wherein the first actuator is connected to the upper arm, wherein the means for holding one or more bits to be ground has one or more apertures to hold one or more bits to be ground and includes a moveable pressure plate for each aperture wherein the shank of a bit is held between said pressure plate and the sides of one of said apertures wherein movement of said pressure plate is controlled by a second actuator, said control system comprising a programmable control system to monitor, control and adjust one or more operational parameters selected from the group consisting of feed pressure, grinding cup RPM, grinding time, movement of the moveable pressure plate and movement of the actuators.

22. A control system according to claim 21, wherein the actuators are electro-mechanical linear actuators having a screw and motor.

23. A control system according to claim 21 wherein a coolant may be provided to the surface of the hard metal inserts during grinding through one or more outlets in said grinding cup and said grinding machine has an electric motor cooled with the same coolant.

24. A control system according to claim 21 wherein means are provided to lock a bit within one of said apertures and means to partially release the pressure to permit the bits to be rotated without full release of the locking means.

25. A control system according to claim 22 wherein the programmable control system is capable of monitoring current during operation of the motor for the linear actuators to measure and control force produced by the linear actuators.

26. A control system according to claim 22 having a load cell assembly in association with the first actuator to quantify and measure the force being applied during grinding.

27. A grinding apparatus for grinding the hard metal inserts of rock drill bits, said grinding apparatus having a grinding machine carried on an support system and means for holding one or more bits to be ground, said grinding machine equipped with a grinding cup driven by a motor to rotate about its longitudinal axis, wherein the support system comprises an arm or lever system to control movement of the grinding machine for alignment of the grinding machine with a hard metal insert to be ground, means to provide grinding pressure, means to monitor and control one or more operational functions of the grinding apparatus selected from the group consisting of force, grinding pressure, movement and speed of movement of the grinding machine during alignment with a hard metal insert, wherein the means to provide grinding pressure includes a linear actuator and means to quantify and measure the force being applied during grinding, the linear actuator or other part or assembly of the grinding machine further includes means to enable the grinding machine to move slightly during grinding over an uneven surface on the hard metal insert without adjustment of the linear actuator, and a programmable control system to monitor, control and adjust grinding pressure by adjusting the speed and length of travel of said linear actuator.

28. A grinding apparatus according to claim 27 wherein the linear actuator is an electro-mechanical linear actuator.

29. A grinding apparatus according to claim 28 wherein the electro-mechanical linear actuator has a screw and motor and the programmable control system controls the motor of the linear actuator to control the speed and length of travel of the screw for the linear actuator.

30. Grinding apparatus according to claim 29 wherein the programmable control system is capable of monitoring current during operation of the motor for the linear actuator to measure and control force produced by the linear actuator.

31. A grinding apparatus for grinding rock drill bits, said grinding apparatus having a grinding machine carried on an support system and means for holding one or more rock drill bits to be ground, said grinding machine equipped with a grinding cup driven by a motor to rotate about its longitudinal axis, wherein the support system comprises an arm or lever system to control movement of the grinding machine for alignment of the grinding machine with a rock drill bit to be ground, means to provide grinding pressure, means to monitor and control one or more operational functions of the grinding apparatus selected from the group consisting of force, grinding pressure, movement and speed of movement of the grinding machine during alignment with the rock drill bit, wherein the means to provide grinding pressure includes a linear actuator and a load cell assembly to quantify and measure the force being applied during grinding, the linear actuator and load cell assembly or other part or assembly of the grinding machine further includes means to enable the grinding machine to move slightly during grinding over an uneven surface on the rock drill bit without adjustment of the linear actuator, and a programmable control system to monitor, control and adjust grinding pressure based on input from the load cell by adjusting the speed and length of travel of said linear actuator.

* * * * *